US006766676B2

(12) United States Patent
Gorski

(10) Patent No.: US 6,766,676 B2
(45) Date of Patent: Jul. 27, 2004

(54) ROLL FORMING MACHINE WITH QUICK-CHANGE PROFILE

(75) Inventor: Michael Gorski, Sayreville, NJ (US)

(73) Assignee: Englert, Inc., Perth Amboy, NJ (US)

( * ) Notice: Subject to any disclaimer, the term of this patent is extended or adjusted under 35 U.S.C. 154(b) by 0 days.

(21) Appl. No.: 10/318,783

(22) Filed: Dec. 13, 2002

(65) Prior Publication Data

US 2004/0112103 A1 Jun. 17, 2004

(51) Int. Cl.[7] ..... B21D 5/14
(52) U.S. Cl. ..... 72/181; 72/226
(58) Field of Search ..... 72/226, 181, 176, 72/179

(56) References Cited

U.S. PATENT DOCUMENTS 3,453,852 A * 7/1969 Valente ..... 72/226
3,636,903 A * 1/1972 Anderson et al. ..... 72/181
3,777,531 A * 12/1973 McClain ..... 72/181
4,974,435 A * 12/1990 Vandenbroucke ..... 72/176
5,007,272 A * 4/1991 Matsunaga et al. ..... 72/226
5,829,294 A * 11/1998 Bradbury et al. ..... 72/176

FOREIGN PATENT DOCUMENTS

DE 25 56 976 * 6/1977 ..... 72/181

* cited by examiner

*Primary Examiner*—Daniel C. Crane
(74) *Attorney, Agent, or Firm*—David L. Davis

(57) ABSTRACT

A roll forming machine of the type which forms an indeterminate length panel of a desired lateral profile from a uniform width supply strip of sheet metal having a pair of parallel straight edges, wherein the machine defines a predetermined path of travel for the supply strip. The machine includes an arrangement for selectively changing the profile along an edge of the panel. The arrangement includes a mounting plate member mounted to a side of the machine and a module including first and second roll forming stations. The module is adapted for mounting to the mounting plate member with a selected one of the first and second roll forming stations along the predetermined path of travel. Structure is provided for allowing the securement of the module to the mounting plate member to be loosened, whereby the mounting plate member is movable between first and second predetermined positions wherein a selected one of the first and second roll forming stations is along the predetermined path of travel.

2 Claims, 8 Drawing Sheets

ROLL FORMING MACHINE WITH QUICK-CHANGE PROFILE

BACKGROUND OF THE INVENTION

This invention relates to roll forming machines which form an indeterminate length panel of a desired lateral profile from a supply strip of sheet metal and, more particularly, to such a machine which has the capability whereby an operator can quickly change the profile along an edge of the panel.

Roll forming machines are well known in the home building and remodeling industry. Such a machine is typically mounted on the bed of a pick-up truck, van, trailer, or the like, so that it can be transported to, and used at, the site where siding panels, roofing panels and rain gutters are to be installed. Typically, such a machine comprises a series of spaced forming stations each having upper and lower shaping rollers between which a sheet metal strip is passed so as to impart a desired shape to the sheet metal strip which is uniform along the length of the sheet metal strip after it exits the machine. Different combinations of rollers provide different lateral profiles to the strip. Conventionally, each machine is designed to provide a single predetermined lateral profile to the sheet metal strip. In order to change the profile, the forming stations have to be removed and replaced with other forming stations. Until now, this has been a time consuming task which may have had to be done away from the site at which the machine is to be used. In the case of roofing panels, for example, sometimes the roofing panels have to be formed with a first profile along an edge which is used when nailing the roofing panels to the underlying roof structure and be formed with a different profile along that edge when mounting clips are used to secure the roofing panel to the underlying roof structure. Often, the same underlying roof structure needs roofing panels of both types at different locations on the underlying roof structure. It would therefore be desirable to provide a roll forming machine wherein the profile along the edge can be quickly changed by the operator on-site.

SUMMARY OF THE INVENTION

According to the present invention, there is provided an arrangement for selectively changing the profile along an edge of a panel formed by a roll forming machine of the type which forms an indeterminate length panel of a desired lateral profile from a uniform width supply strip of sheet metal having a pair of parallel straight edges, with the roll forming machine defining a predetermined path of travel for the supply strip. The inventive arrangement comprises a mounting plate member mounted to a side of the machine, and a module including first and second roll forming stations adapted for mounting to the mounting plate member with a selected one of the first and second roll forming stations along the predetermined path of travel.

In accordance with an aspect of this invention, the first and second roll forming stations are located on the module so that when the module is mounted to the mounting plate member with a selected one of the first and second roll forming stations along the predetermined path of travel, the other of the first and second roll forming stations is vertically displaced from the predetermined path of travel.

In accordance with another aspect of this invention, the mounting plate member is formed with a pair of spaced parallel slots elongated in the vertical direction and the module includes a back plate formed with two parallel rows of threaded mounting holes, the two rows being registrable with the pair of slots when the back plate abuts the mounting plate member. The inventive arrangement further includes a plurality of mounting bolts extendable through the slots into threaded engagement with selected ones of the mounting holes to secure the module to the mounting plate member at a selected one of two vertical positions so that a desired one of the roll forming stations is along the predetermined path of travel.

In accordance with a further aspect of this invention, the mounting plate member is formed with a first locating through-hole and the back plate is formed with a pair of second locating holes spaced along a line parallel to the two rows of mounting holes. Each of the pair of second locating holes is selectively registrable with the first locating through-hole when the module is at a respective one of the two vertical positions. The inventive arrangement further includes a locating pin insertable through the first locating through-hole and into a selected one of the pair of second locating holes.

BRIEF DESCRIPTION OF THE DRAWINGS

The foregoing will be more readily apparent upon reading the following description in conjunction with the drawings in which like elements in different figures thereof are identified by the same reference numeral and wherein:

FIGS. 6A–9A are elevational views showing the steps in converting the inventive roll forming machine from one edge profile to another edge profile; and FIGS. 6B–9B are side views corresponding to FIGS. 6A–9A, respectively.

DETAILED DESCRIPTION

Figure 1:
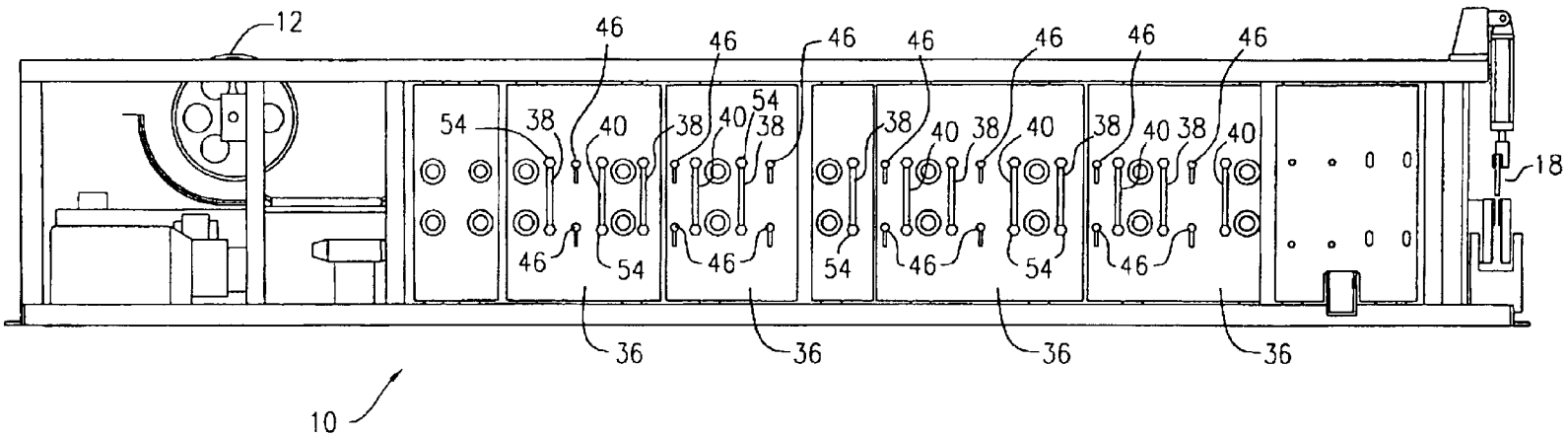
FIG. 1 is a schematic side view of a roll forming machine according to the present invention.
Figure 2:
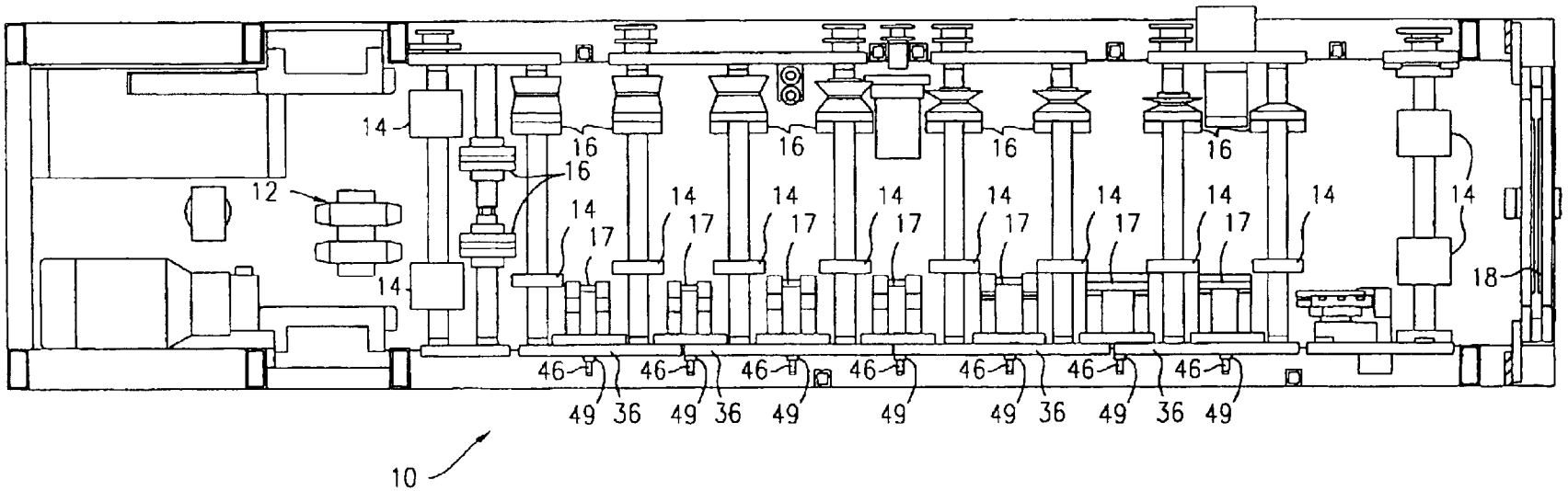
FIG. 2 is a schematic top view below the top rail of the roll forming machine shown in FIG. 1.

Referring now to the drawings, FIGS. 1 and 2 schematically show a roll forming machine, designated generally by the reference numeral 10, in which the present invention is incorporated. Illustratively, the machine 10 is for forming roofing panels. As is conventional, the machine 10 has a spindle 12 at one end for supporting a supply strip coil of sheet metal (not shown). The sheet metal supply coil strip is of uniform width and has a pair of parallel straight edges. The supply strip of sheet metal is pulled by driven rollers 14 so as to travel along a predetermined path through the machine 10 and past a plurality of spaced roll forming stations 16. At the end of the machine 10 remote from the spindle 12 is a cutting station 18 for cutting the formed roofing panel to a desired length.

Figure 3:
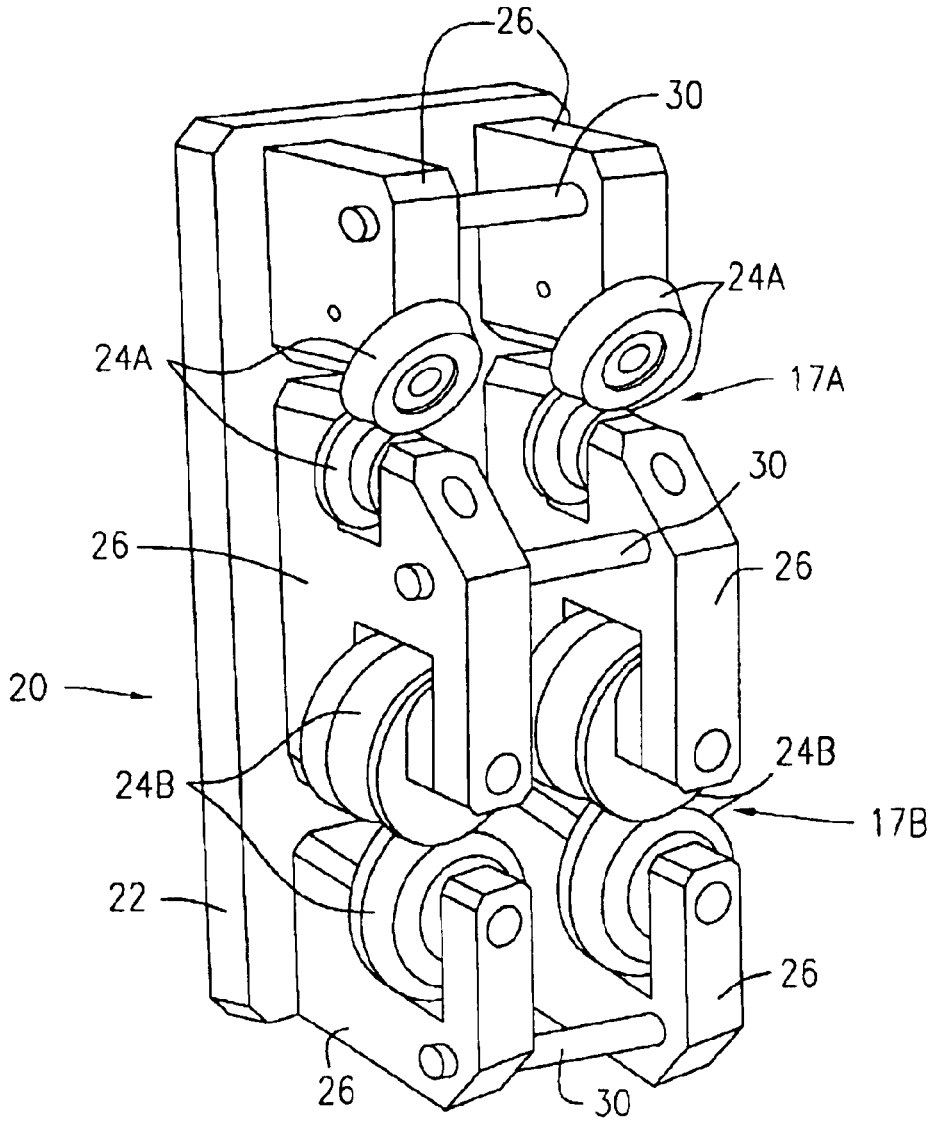
FIG. 3 is a perspective view of a module including first and second roll forming stations according to the present invention.
Figure 4:
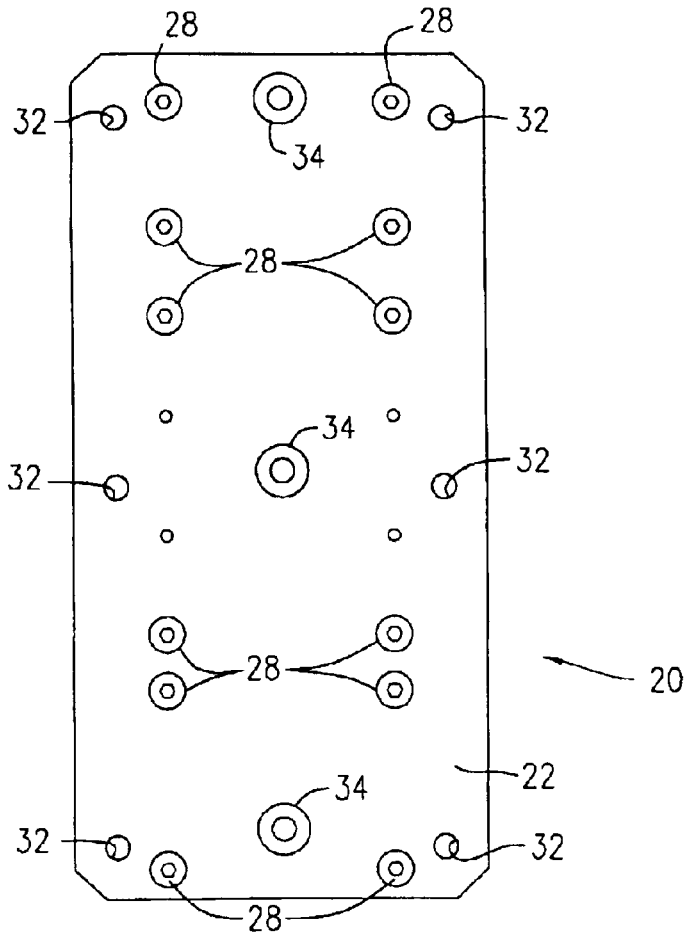
FIG. 4 is an elevational view of the back plate of the module shown in FIG. 3.

As discussed previously, it is often desirable to be able to change, on-site, the edge profile of the roofing panel so that the panel can be secured to the underlying roof structure either by nails or by clips. The roll forming stations 17 along one side of the machine 10 are the ones that form the desired edge profile. According to the present invention, there is provided a module 20, as shown in FIG. 3, which includes an upper roll forming station 17A and a lower roll forming station 17B which are used to form the desired edge profiles. The module 20 includes a back plate 22 to which are mounted the roll forming stations 17A, 17B in vertical alignment one with the other. Each of the roll forming stations 17A, 17B includes rollers 24A, 24B, respectively, rotatably mounted to bracket pieces 26 which are secured to the back plate 22, illustratively by Allen screws 28 (FIG. 4) or the like. Rods 30 extending between respective pairs of the bracket pieces 26 provide lateral stability to the bracket pieces 26.

The back plate 22 of the module 20 is formed with two parallel vertical rows of threaded mounting holes 32. The back plate 22 is also formed with a vertical row of locating holes, each fitted with a bushing 34, which is parallel to the rows of mounting holes 32. Illustratively, each of the rows of mounting holes and locating holes includes three such holes.

To support the modules 20, the machine 10 is provided with a mounting plate member 36 along one of its sides. Illustratively, there may be a plurality of smaller mounting plate members 36 making up a larger overall mounting plate member. In any event, the mounting plate member 36, for each individual module 20, is formed with a pair of spaced parallel slots 38, 40 elongated in the vertical direction. The slots 38, 40 are spaced equally to the spacing between the two rows of threaded mounting holes 32 on the back plate 22 of the module 20. The mounting plate member 36 is further formed with a pair of locating through-holes 42, 44 arrayed along a line between and parallel to the slots 38, 40. The locating through-holes 42, 44 are so situated on the mounting plate member 36 as to be alignable with a respective pair of the locating holes in the back plate 22 when the threaded mounting holes 32 in the back plate 22 are aligned with the slots 38 and 40 of the mounting plate member 36.

Figure 5:
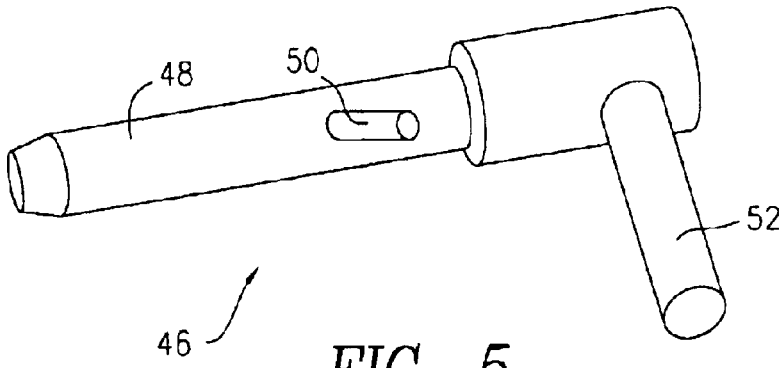
FIG. 5 is a perspective view of a locating pin utilized with the present invention.

In accordance with this invention, there is also provided a locating pin 46 (FIG. 5), having a rod 48 adapted to be insertable through one of the locating through-holes 42, 44 in the mounting plate member 36 and into one of the bushings 34 fitted into a locating hole in the back plate 22. Although not shown in detail, the mounting plate member 36 is provided with a collar 49 surrounding each of the locating through-holes 42, 46. The collar 49 includes a keyway adapted to receive the key pin 50 extending orthogonally from the rod 48 of the locating pin 46 to secure the locating pin 46 in place. The locating pin 46 is also provided with a handle rod 52 for manual manipulation thereof.

Figure 6B:
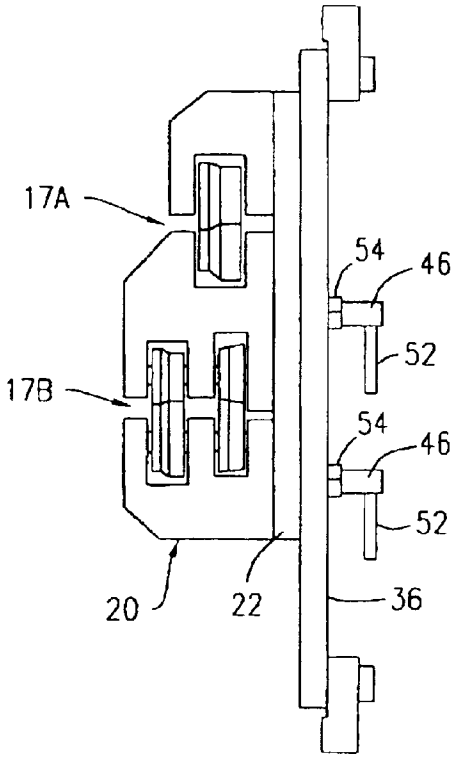
Figure 6A:
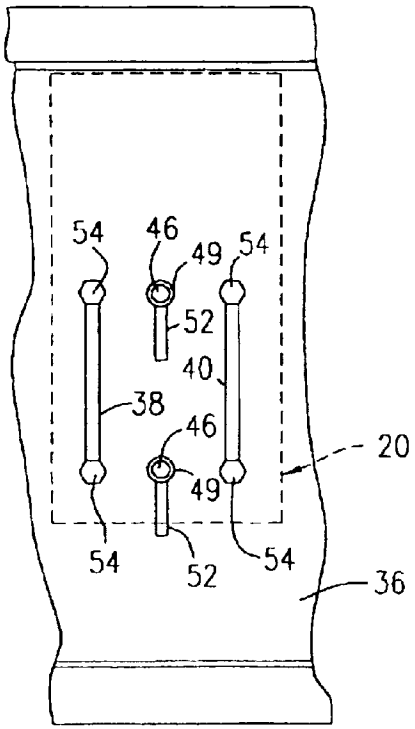
Figure 7B:
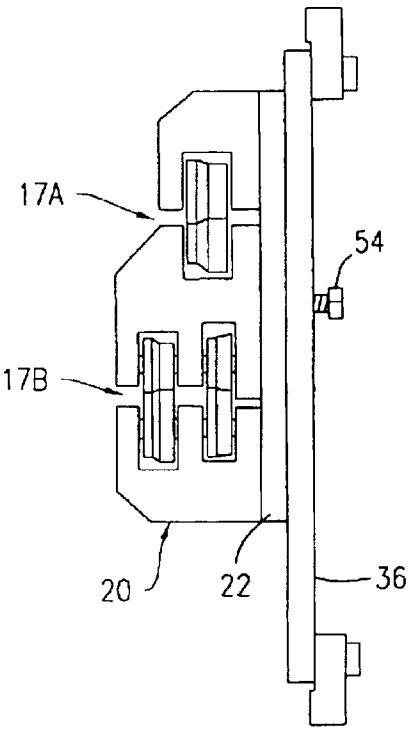
Figure 7A:
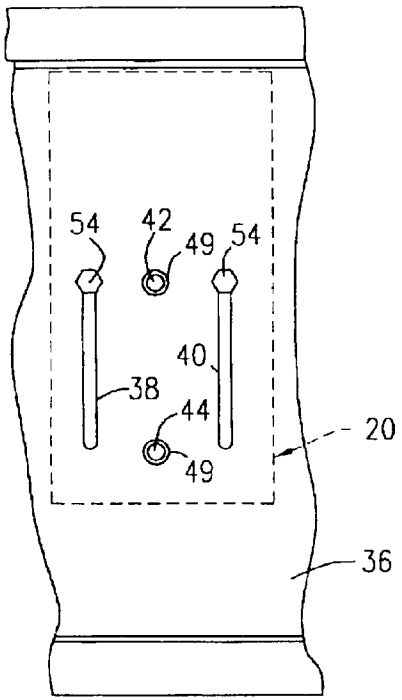
Figure 8B:
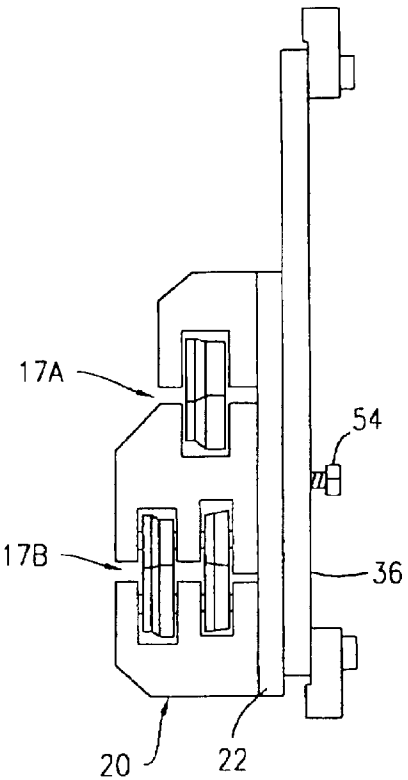
Figure 8A:
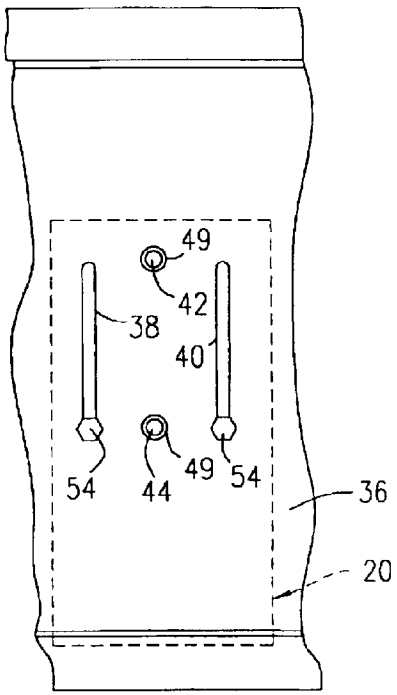
Figure 9B:
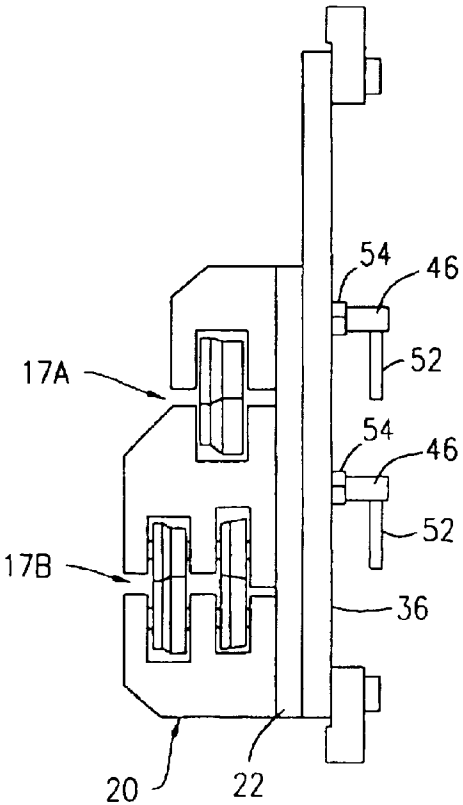
Figure 9A:
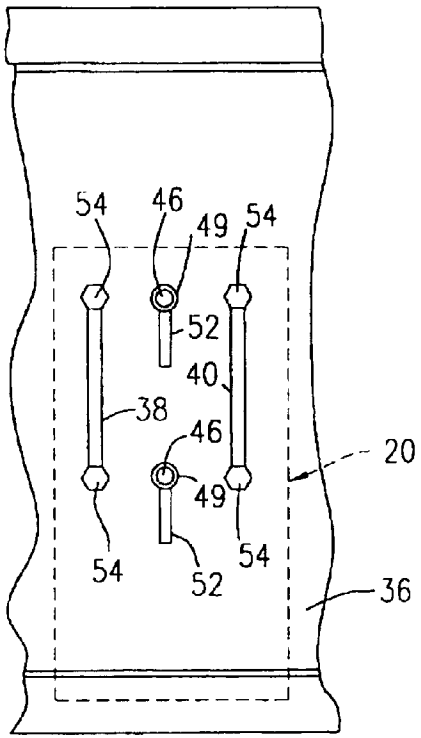

FIGS. 6A, 6B through 9A, 9B illustrate the mounting of a module 20 on the mounting plate member 36 to form two different edge profiles and the simple steps for converting therebetween. FIGS. 6A and 6B illustrate the mounting of a module 20 with the roll forming station 17B along the predetermined path of travel of the supply strip of sheet metal. The module 20 is secured by the four bolts 54 which extend through the slots 38, 40 and are received within the four lower threaded mounting holes 32 of the back plate 22. The locating pins 46 extend through the locating through-holes 42, 44 of the mounting plate member 36 and into the two lower bushings 34 of the module 20. The locating pins 46 are use to precisely locate the module 20 on the mounting plate member 36 and the bolts 54 are used to secure the module 20 at that precise location so that the roll forming station 17B is along the predetermined path of travel of the supply strip of sheet metal. When it is desired to convert the machine 20 to change the edge profile by utilizing the roll forming station 17A in place of the roll forming station 17B, as shown in FIGS. 7A and 7B, the two lower bolts 54 and the locating pins 46 are removed and the upper bolts 54 are loosened. As shown in FIGS. 8A and 8B, the module 20 is then lowered, with the bolts 54 moving from the top to the bottom of the slots 38, 40. Next, the locating pins 46 are inserted through the locating through-holes 42, 44 of the mounting plate member 36 and the position of the module 20 is adjusted until the locating pins 46 can freely enter the upper two bushings 34 of the module 20. The previously removed bolts 54 are then inserted through the slots 38, 40 and are received by the upper two threaded mounting holes 32 in the back plate 22 of the module 20. All four bolts 54 are then tightened. The machine 10 is now ready to utilize the roll forming station 17A to form the desired edge profile on the supply strip of sheet metal.

Accordingly, there has been disclosed a roll forming machine having the capability whereby an operator can quickly change the profile along the edge of a supply strip of sheet metal. While an illustrative embodiment of the present invention has been disclosed, it is understood that various adaptations and modifications to the disclosed embodiment are possible. Thus, for example, instead of a vertical translation of the module, it is contemplated that a rotation of the module can also be effected. Also, more than two roll forming stations can be incorporated in each module. It is therefore intended that this invention be limited only by the scope of the appended claims.

What is claimed is:

1. In a roll forming machine of the type which forms an indeterminate length panel of a desired lateral profile from a uniform width supply strip of sheet metal having a pair of parallel straight edges, said roll forming machine defining a predetermined path of travel for said supply strip, an arrangement for selectively changing the profile along an edge of the panel comprising:

a mounting plate member mounted to a side of the machine, wherein said mounting plate member is formed with a pair of spaced parallel slots elongated in the vertical direction;

a module including first and second roll forming stations adapted for mounting to said mounting plate member with a selected one of said first and second roll forming stations along said predetermined path of travel, wherein said first and second roll forming stations are located on said module so that when said module is mounted to said mounting plate member with a selected one of said first and second roll forming stations along said predetermined path of travel the other of said first and second roll forming stations is vertically displaced from said predetermined path of travel, said module including a back plate formed with two parallel vertical rows of threaded mounting holes, said two rows being registrable with said pair of slots when said back plate abuts said mounting plate member; and a plurality of mounting bolts extendable through said slots into threaded engagement with selected ones of said mounting holes to secure said module to said mounting plate member at a selected one of two vertical positions so that a desired one of said roll forming stations is along said predetermined path of travel.

2. The arrangement according to claim 1, wherein:

said mounting plate member is formed with a first locating through-hole; and said back plate is formed with a pair of second locating holes spaced along a line parallel to said two rows of mounting holes and each selectively registrable with said first locating through-hole when said module is at a respective one of said two vertical positions of mounting holes;

said arrangement further including a locating pin insertable through said first locating through-hole and into a selected one of said pair of second locating holes.

* * * * *